US007248806B2

(12) United States Patent
Askren et al.

(10) Patent No.: US 7,248,806 B2
(45) Date of Patent: Jul. 24, 2007

(54) PADDLE POSITIONING SYSTEM

(75) Inventors: Benjamin Alan Askren, Lexington, KY (US); Lenci Robert Kappes, Lexington, KY (US); Steven Michael Turney, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 21 days.

(21) Appl. No.: 11/126,835

(22) Filed: May 11, 2005

(65) Prior Publication Data

US 2006/0257171 A1 Nov. 16, 2006

(51) Int. Cl.
*G03G 15/06* (2006.01)
*G03G 15/08* (2006.01)

(52) U.S. Cl. ..... 399/27; 399/222; 399/254

(58) Field of Classification Search ..... 399/254, 399/24, 30

See application file for complete search history.

(56) References Cited

U.S. PATENT DOCUMENTS 5,506,665 A 4/1996 Ishida et al.
5,612,770 A 3/1997 Bandai et al.
5,678,147 A 10/1997 Makino
5,890,034 A 3/1999 Nakano et al.
5,913,097 A 6/1999 Nakano et al.
5,995,789 A 11/1999 Murakami et al.
6,459,876 B1 10/2002 Buchanan et al.
6,496,662 B1 12/2002 Buchanan et al.
6,510,300 B2 1/2003 Mizoguchi et al.
6,510,303 B2 1/2003 Bessette
6,654,569 B2 11/2003 Nozawa
6,771,922 B2 8/2004 Blanck et al.
6,810,226 B2 10/2004 Phillips et al.
6,871,031 B2 3/2005 Blaine et al.
2005/0002698 A1* 1/2005 Jeon ..... 399/254
2005/0053386 A1* 3/2005 Takuma et al. ..... 399/27
2005/0129417 A1* 6/2005 Asakura ..... 399/27

* cited by examiner

*Primary Examiner*—David M. Gray
*Assistant Examiner*—David Blackshire
(74) *Attorney, Agent, or Firm*—Grossman, Tucker, Perreault & Pfieger, PLLC

(57) ABSTRACT

The present invention is directed to an article, system and method for determining and/or selecting the location of a toner engaging member in a developing agent device such as a toner cartridge. The article, system and method may be applied to a printing device such as a laser printer.

17 Claims, 13 Drawing Sheets

Chart X-Axis Reference

PADDLE POSITIONING SYSTEM

FIELD OF INVENTION

The present invention relates to image forming devices including a developing agent device and a system and method that may increase the operational life of, e.g., a toner cartridge.

BACKGROUND

Electrophotographic devices, such as printers, copiers or faxes, may use a developing agent, such as toner, to form images on sheets of media. The developing agent may be stored in a cartridge or other device. The developing agent device may be either fixed or removable from said electrophotographic device.

Developing agent devices may incorporate agitators within the cartridges to stir the toner particles during operation, which may help prevent clumps and keep the toner particles fluid. Agitators may include paddles or other members that may sweep the inner surface of the developing sump, or the area of the device in which the developing agent may be stored. As media is fed through the printing device, the agitators may also help feed the developing agent to the developing portion of the printing device.

Developing agent devices may also include sensors, such as optical sensors, to determine when the device is out of developing agent. Optical systems may use transparent windows located within the sump area of the cartridge. A signal emitter and sensor, for example, may be placed in communication with a reflector inside of the sump area. In some instances, signal quality may be correlated with the amount of toner in the sump.

SUMMARY

An exemplary embodiment of the present invention relates to a method comprising providing a developing agent device, capable of containing toner, including a toner engaging member capable of contacting toner and providing a sensor within the developing agent device, capable of providing signals. The method also includes sampling signals from the sensor and determining when the toner engaging member engages the sensor.

Another exemplary embodiment of the present invention relates to a method comprising providing a developing agent device, capable of containing toner, including a toner engaging member capable of contacting toner and providing a sensor, wherein the sensor is capable of providing signals. The method also includes sampling signals from the sensor and determining an event occurrence by monitoring an output voltage v of the sensor at a time n and a previous time n-x to provide an output voltage difference $(v_{(n)}-v_{(n-x)})$; measuring a maximum voltage output $v_{max}$ and a minimum voltage output $v_{min}$ and calculating $(v_{min}-v_{max})$. The event may be determined to occur when $(v_{(n)}-v_{(n-x)})<f(v_{min}-v_{max})$ wherein f may be a constant. The event may be associated with the toner engaging member engaging the sensor and/or the toner engaging the sensor.

A further exemplary embodiment of the present invention relates to a printer comprising a toner containing device, capable of containing toner, including a toner engaging member capable of contacting toner and a sensor wherein the toner engaging member may be capable of engaging the sensor. The printer may also include a processor in communication with the sensor capable of sampling signals from the sensor and determining when the toner engaging member engages the sensor.

Another exemplary embodiment of the present invention relates to an article comprising a storage medium having stored thereon instructions that when executed by a machine result in operations including sampling signals from a sensor; determining when a toner engaging member engages the sensor; and positioning the toner engaging member in a toner containing device at a selected location.

Another exemplary embodiment of the present invention relates to a toner cartridge comprising a toner containing device, capable of containing toner, including a toner engaging member capable of contacting toner and a sensor. The toner engaging member may be capable of engaging the sensor and the sensor may be capable of communicating with a processor which may be capable of sampling signals from the sensor and determining when the toner engaging member engages the sensor.

DETAILED DESCRIPTION

The present application relates to the use of agitating devices inside developing agent devices to agitate the developing agent. More particularly, the present invention relates to preventing creep or deformation of the agitating device by positioning the agitating device so that the agitating device does not remain deflected when the paddle motor stops so as to retain the elastic response of the toner paddle.

Figure 1:
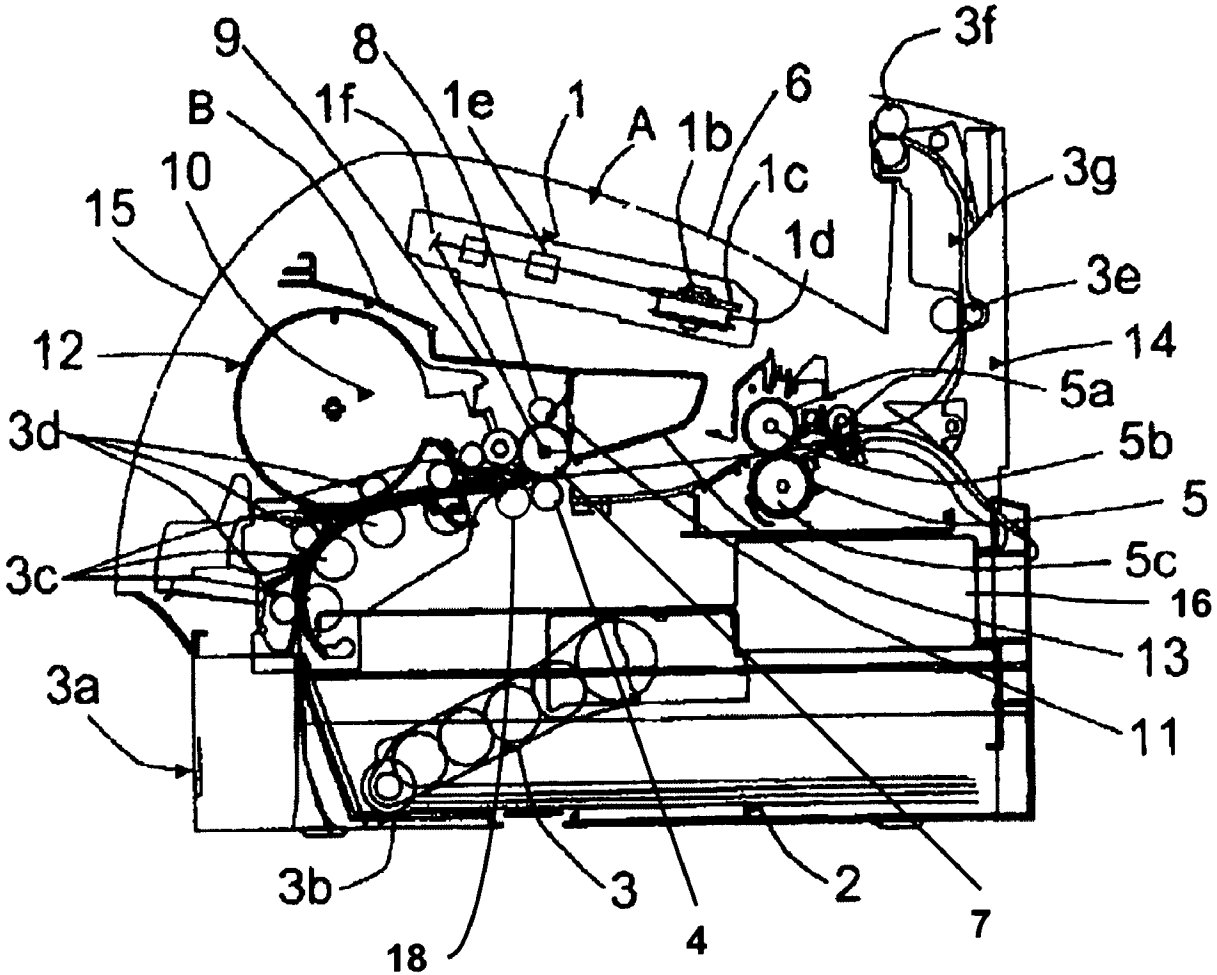
FIG. 1 is an exemplary embodiment of an electrophotographic device.

FIG. 1 depicts an exemplary embodiment of an electrophotographic device "A". In one embodiment the image-forming electrophotographic apparatus A may include the following components: an optical device, a feeding device, a transfer device, a fixing device, and a cartridge mounting device, described herein.

The optical device 1 may project a light image onto a photosensitive drum 7 by projecting light on the basis of image information read from an external apparatus or the like. As shown in FIG. 1, a laser diode 1*b*, a polygon mirror 1*c*, a scanner motor 1*d*, and an image-forming lens 1*e* may be housed inside an optical unit 1 of the main body 14 of the apparatus. When, for example, an image signal may be supplied from an external apparatus, such as a computer or word processor, to the printer or to a microprocessor 16 within the printer, the laser diode 1*b* may emit light in response to the image signal, and projects the light onto the polygon mirror 1*c* as image light. Polygon mirror 1*c* may be rotated at high speed by the scanner motor 1*d*. The image light reflected by the polygon mirror 1*c* may be projected onto the photosensitive drum 7 via the image-forming lens 1*e* and reflecting mirror 1*f*. The surface of the photosensitive drum 7 may thus be selectively exposed to form a latent image corresponding to the image information.

The feeding device 3 for feeding the recording medium 2 (e.g., recording paper, cardstock, OHP sheet, envelopes, cloth, thin plate, etc.) may include the following components. A loading portion of a cassette 3*a* may be provided in the inner bottom portion of the main body 14 of the apparatus. Upon the input of an image formation start signal, the recording media 2 within the cassette 3*a* may be fed one-by-one from the top of the stack by a pickup roller 3*b*, feeding rollers 3*c* and follower rollers 3*d*, pressed against the feeding roller 3*c*.

A sheet of recording medium 2 may be fed to the nip portion between the photosensitive drum 7 and the transfer device 4 in synchronization with the performing of the image-formation operation described above, transferring the image to the recording medium. The recording medium 2 onto which a developed image has been transferred may be fed to the fixing device 5 and then ejected onto the ejection tray 6 by a pair of intermediate ejection rollers 3*e* and a pair of ejection rollers 3*f*. A pair of guide members 3*g* for guiding the feeding of the recording medium 2 may be provided between each of the above-mentioned pairs of rollers.

The transfer device 4 transfers the developed latent image or toner image formed on the photosensitive drum 7 in the image-forming section onto the recording medium 2. The transfer device 4 consists of the transfer roller 4 as shown in FIG. 1. That is, the recording medium 2 may be pressed by the transfer roller 4 against the photosensitive drum 7 of the loaded process cartridge B. A voltage having a polarity opposite that of the latent image formed on the photosensitive drum 7 may be applied to the transfer roller 4 so that the developing agent on the photosensitive drum 7 may be transferred to the recording medium 2.

The fixing device 5 may fix the developing agent image transferred to the recording medium 2 by applying heat and pressure to the recording medium 2 carrying the toner image. As shown in FIG. 1, the fixing device 5 may comprise a driving rotating roller 5*a* having a heater 5*b* therein, and a fixing (pressure) roller 5*c*, rotating in a driven manner in pressed contact with the drive roller 5*a*. More specifically, when the recording medium 2 to which the developing agent image has been transferred moves between drive roller 5*a* and fixing roller 5*c*, heat may be applied by the heater located in the driving rotating roller 5*a* and pressure may be applied to the recording medium by the fixing roller 5*c*, thereby causing the developing agent (which comprises a colorant and a thermoplastic component) on the recording medium 2 to melt and become fixed to the recording medium 2.

Furthermore, the microprocessor 16 may communicate with a computer, network or word processor or the microprocessor 16 may process data within the printer, including data related to sensors and computing algorithms.

A process cartridge loading device by which the process cartridge B is loaded into the image forming apparatus is disposed within the apparatus A. Loading and unloading of the process cartridge B to and from the main body 14 of the apparatus may be performed by opening an open/close cover 15. Open/Close cover 15 may be provided with a conventional hinge (not shown) so that it can be opened or closed, and is mounted in the upper portion of the main body 14 of the apparatus. Opening the open/close cover 15 may reveal a cartridge loading space provided inside the main body 14 of the apparatus and may include conventional left and right guide members (not shown) mounted on the left and right inner-wall surfaces of the main body 14. Each of these guide members may be provided with a guide for inserting the process cartridge or developing agent assembly B. The process cartridge or assembly B may be inserted into and along the guides, and by closing the open/close cover 15. Furthermore, the open/close cover 15 may be provided in communication with a sensor (not illustrated), which may be triggered by opening or closing said cover 15.

Figure 2:
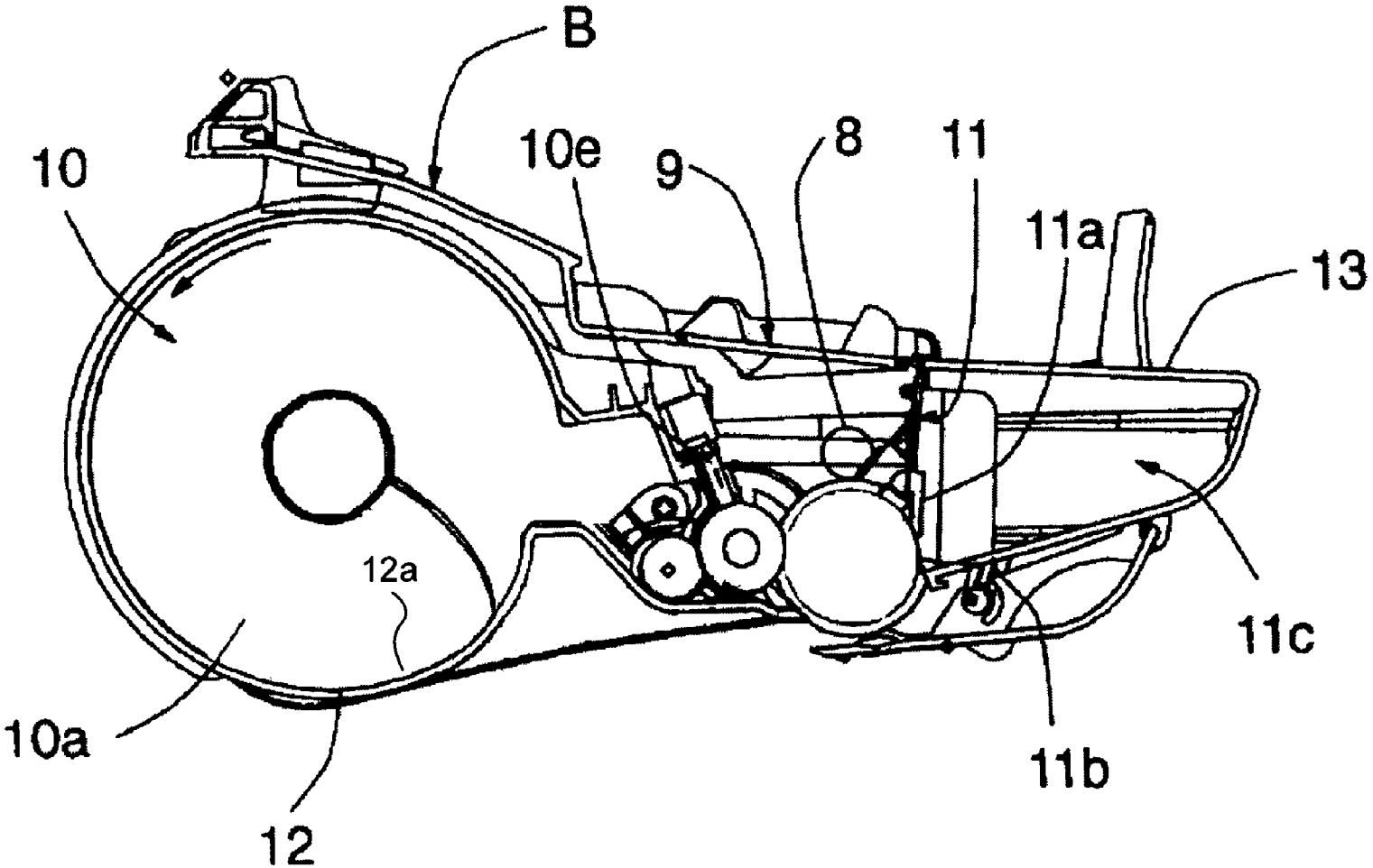
FIG. 2 is an exemplary embodiment of a developing agent device.

The process cartridge or assembly B may comprise an image carrier and at least one process means. The process device may include a charging device for charging the surface of the image carrier, a developing device for forming a toner image on the image carrier, a cleaning device for cleaning the toner remaining on the surface of the image carrier, and the like. In the process cartridge B as shown in FIG. 2, the charging device 8, the exposure section 9, the developing device 10, and the cleaning device 11 may be arranged around a photosensitive drum 7, which is an image carrier. These elements may be housed within a frame member formed of the developing agent frame member 12 and the cleaning frame member 13 so that they may be formed into one unit, thus making it possible to load and unload the unit into and out of the main body 14 of the apparatus. The process cartridge B may include the following elements: the photosensitive drum 7, the charging device 8, the exposure section 9, the developing device 10 and the cleaning device 11.

The photosensitive drum 7 may have an organic photosensitive layer coated onto the outer peripheral surface of a cylindrical drum base formed from aluminum. The photosensitive drum 7 may be rotatably mounted on a frame member of the cartridge and the driving force of a drive motor disposed in the main body 14 of the apparatus may be transmitted to a drum cap (not shown). As a result, the photosensitive drum 7 may be caused to rotate in the direction of the arrow.

The charging means 8 may be used to uniformly charge the surface of the photosensitive drum 7. Preferably, a so-called contact charging method in which the charging means 8 is mounted on frame member 14 may be used.

The charging means 8 may be brought into contact with the photosensitive drum 7 so that the charging means 8 contacts the photosensitive drum 7 during the image formation. A DC voltage may be applied to the charging means 8 and the surface of the photosensitive drum 7 may be uniformly charged.

An exposure section 9 exposes a light image projected from the optical means onto the surface of the photosensitive drum 7 uniformly charged by the charging roller 8 so that a latent image may be formed on the surface of the photosensitive drum 7. An opening 9 for guiding the light image onto the top surface of the photosensitive drum 7 may be provided to form the exposure section.

As shown in FIG. 2, the developing means may include a developing agent reservoir 10*a* or housing for the developing agent, and a toner engaging member or paddle 10*b*. The toner engaging member 10*b* or agitator may be provided within toner reservoir 10*a* and may rotate along path a as shown in FIG. 2 to circulate toner within the toner reservoir 10*a* and transfer the toner to a toner roll 10*c*. A developer roll 10*d* may form a thin toner layer on the surface thereof as a result of its rotation against the toner roller 10*c* and may be pressed against the photosensitive drum 7.

Figure 3:
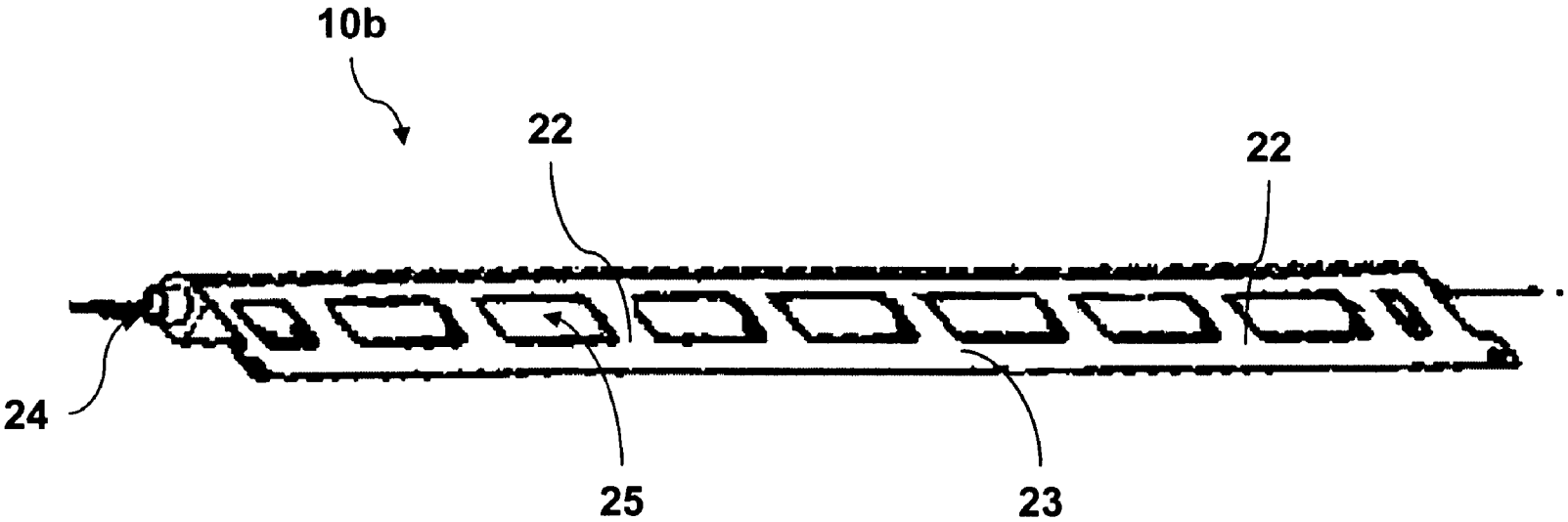
FIG. 3 an exemplary embodiment of an agitator, or paddle, located within said developing agent device.

The toner feeding member 10*b* may act as an agitator for the toner and may be generally configured as a paddle that extends substantially the width of the toner reservoir 10*a*. The size of the paddle 10*b* may be such that during rotation the outer end or tip of the paddle may come within close proximity to the inner surface of cylindrical wall 12*a* to agitate the toner and move it towards roll 10*c*. The paddle 10*b* may have a variety of configurations and may be substantially flat or slightly curved. An exemplary embodiment of a configuration of the paddle 10*b* is illustrated in FIG. 3. The paddle 10*b* may include a number of openings 25 defined by longitudinal member 23 or a series of short members (not illustrated) and fingers 22 extending from the drive shaft 24.

Referring back to FIG. 2, a development blade (also called a "doctor blade") 10*e* may be disposed adjacent the developer roll 10*d* to regulate the thickness of the toner layer formed therebetween. An electric charge may be imparted to the toner by a biasing voltage on the doctor blade 10*e*.

As shown in FIG. 2, the cleaning means 11 may comprise a cleaning blade 11*a*, positioned in contact with the surface of the photosensitive drum 7 for scraping off the toner remaining on the photosensitive drum 7. The cleaning device 11 may also include a skimming seal 11*b*, positioned below the cleaning blade 11*a* and arranged in a relatively weak contact with the surface of the photosensitive drum 7, for retaining the toner which has been scraped off. A waste toner well 11*c* may also be included for storing the scraped-off waste toner.

Figure 4:
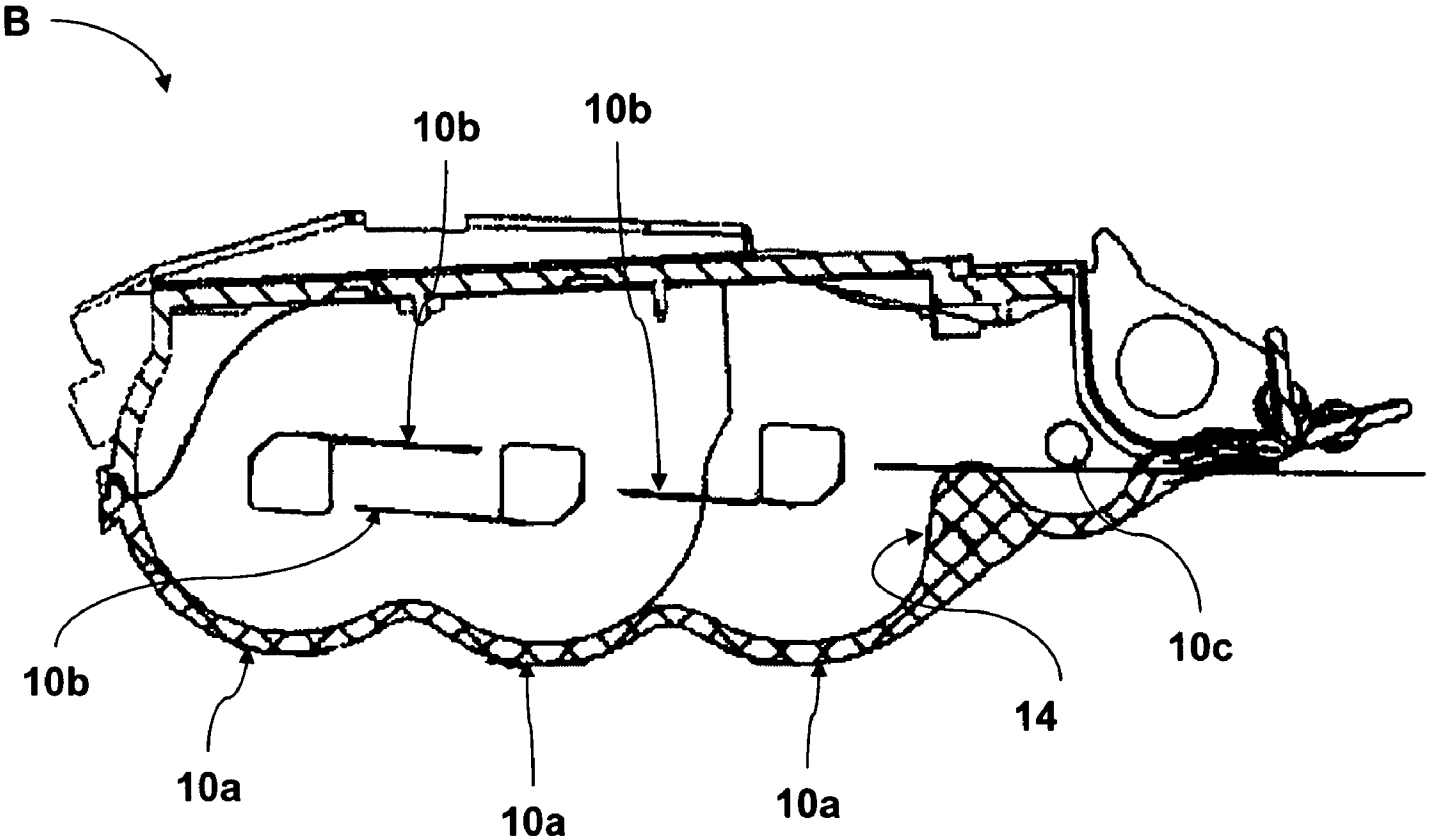
FIG. 4 is another exemplary embodiment of a developing agent device.

Another exemplary embodiment is illustrated in FIG. 4. In this embodiment, the process device B contains three developing agent sumps 10*a* and has a slightly different overall geometry. Three paddles 10*b* are provided in the cartridge which may aid in breaking up the toner and/or move the toner forward to the toner roller 10*c*. The sump 10*a* closest to the toner roller 10*c* may include interference feature 14. Accordingly, it should be understood that a variety of developing agent device configurations including varying numbers of sumps and paddles are contemplated in the present invention.

Referring back to FIG. 2 one aspect of the present invention is directed at supplying toner to the toner supply roll 10*c*. The toner may be supplied so that it may preferably cover the toner roller 10*c* and it may therefore preferably reduce or prevent starvation of the developer roller 10*d*. The toner feeding member 10*b* may impart kinetic energy to the toner particles to move them forward to the toner roll 10*c*, which may be a flexible or elastomeric. The toner feeding member may be employed in combination with an interfering feature 14 or wall formed in frame member 12. As shown in FIG. 2 the toner frame member 12 may generally be cylindrical in shape so that the toner feeding member 10*b* may travel on a path $\alpha$ within the frame to agitate and feed toner without interfering with the frame member 12.

Figure 5:
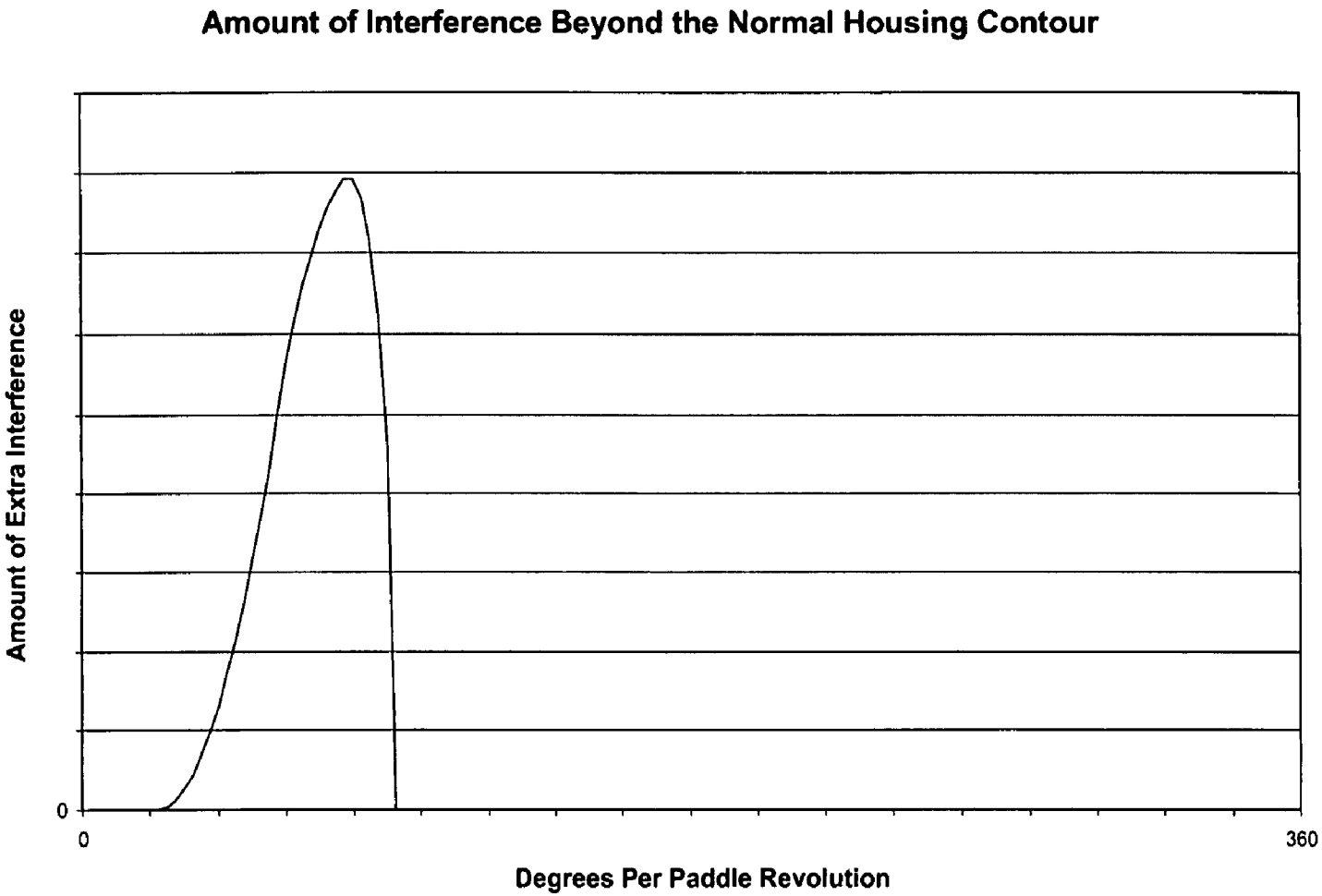
FIG. 5 is a graphical representation of an exemplary degree of interference between the interference feature and paddle during a revolution of the paddle.

The toner feeder member 10*b* may be rotated by shaft 24, in the direction of a such that the member 10*b* is not in contact with the inner circumference of wall 12, but may make contact or interfere with non-circumferential wall or feature 14. This interference may cause the member 10*b* to deflect or flex such that upon further rotation of the member by the shaft, the member clears the interference and recovers to its original shape, transferring energy to any toner particles that it may have encountered. An exemplary graphical representation of the interference between paddle member 10*b* and wall feature 14 as the paddle member rotates 360 degrees about the drive shaft 24 is illustrated in FIG. 5. As can be seen the interference may occur at a selected location during a single revolution.

The material that may form the flexible toner feeding member 10*b* of the present invention may be selected so that it may be flexed when it is positioned as between the inner reservoir wall 12 or interfering feature 14 and drive axis 24. When flexed, the substrate material of the toner feeding member 10*b* may then exhibit an elastic response that may be sufficient to convey toner to the toner roll 10*c*. By elastic response it should be understood that when the toner feeding member is flexed it may initially provide a resistance to such flex and may then respond back, to some degree, towards its original (unflexed) state. This elastic response may simply be realized by the application of a torque to the member 10*b* by the drive shaft 24 effectuated through the engagement of one end of the toner feeding member 10*b* with the toner reservoir wall 12 or interference 14.

It has been found however, that the elastic response of the toner feeding member 10*b* may decrease over the life of the printer, particularly when the toner feeding member 10*b* is positioned on the interfering feature 14 and remains flexed when the drive shaft 24 is stopped, such as at the end of a print job or when the printer is turned off. An aspect of the present invention is directed at a system and method to control the rotation of the toner feeder member 10*b* so that the toner feeding member 10*b* is not positioned on the interfering feature 14 in a flexed state at selected times, such as at "power off" or between print cycles.

Figure 6:
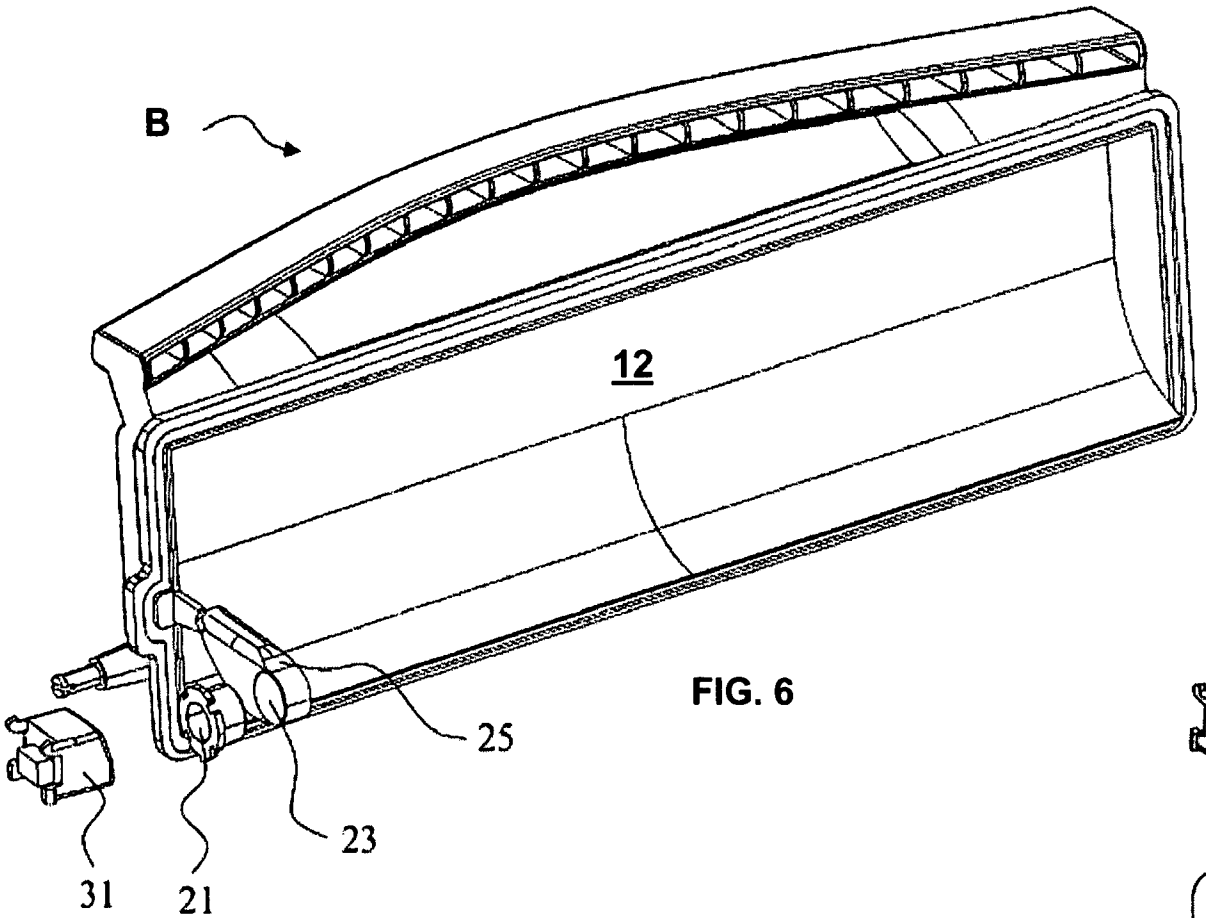
FIG. 6 is another exemplary embodiment of a developing agent device in which a sensor, window and reflective device are provided.

The system and method in the present invention may utilize the toner low sensor, illustrated in FIG. 6 depicting an exemplary embodiment of a portion of a toner cartridge. A window 21 may be provided in the side of the toner cartridge proximate to the bottom of toner reservoir 10*a* (not illustrated). Window 21 may be any material, such as polycarbonate or acrylic, which may be transparent to light, such as visible or infrared light, and which may hold toner inside of the cartridge.

Opposite window 21, a reflective surface 23 may be mounted inside of the toner cartridge B by support member 25. The reflective surface may be spaced from window 21 between about 3 and 40 millimeters and all incremental values therebetween. The reflective surface 23 may be an aluminized plastic sheet, however, any surface sufficient for reflecting light, such as visible or infrared light, may be used in the present invention. Support member 25 may extend from any surface inside of toner reservoir 10*a*, such as from the back surface or the bottom surface.

Figure 7:
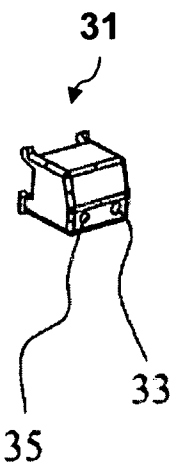
FIG. 7 is a perspective view of an embodiment of the sensor.

Affixed to or extending from the toner cartridge B, may be an optical element 31 having an emitter 33 and a receiver 35, depicted in FIG. 7. Light, such as visible or infrared light, may be emitted from emitter 33 such that it may be reflected from reflective surface 23 and sensed by receiver 35. In one embodiment, as the toner draws low in the toner reservoir 10*a*, the light sensed, from emitter 33, reflected from reflected surface 23 may increase.

Figure 8:
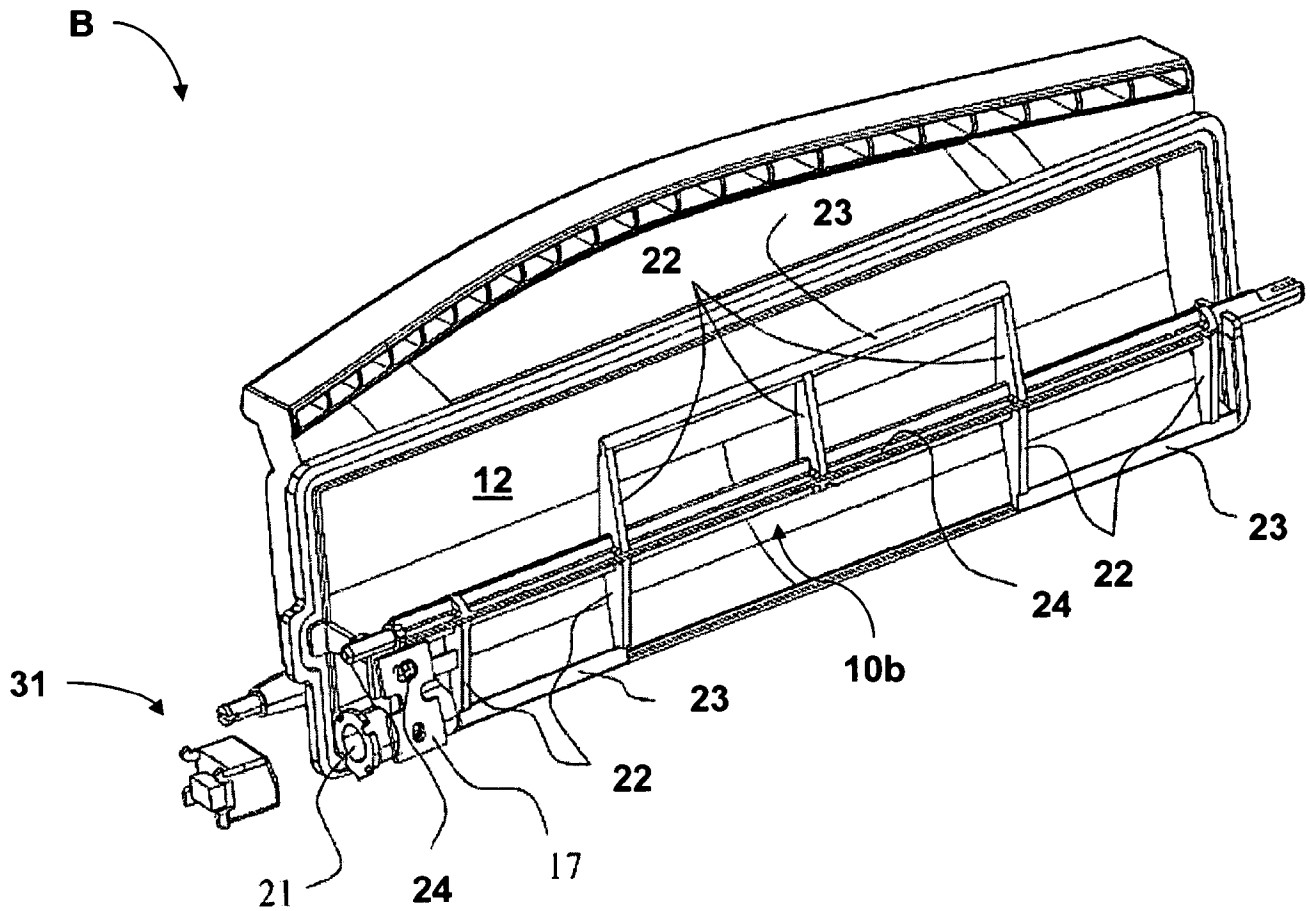
FIG. 8 is another exemplary embodiment of a developing agent device and paddle in which a wiper blade is provided.

In another embodiment either a portion of the paddle, or as illustrated in FIG. 8 a wiper blade 17, may pass between window 21 and reflective surface 23 to clean the two surfaces to allow light to pass through window 21 and be reflected by surface 23 back through to window 21. The wiper blade 17, for example, may be attached to drive shaft 24 and may rotate synchronously and/or with paddle 10*b*. When more than one paddle may be located on the drive shaft 24, the wiper blade 17 may rotate with the paddle 10*b* proximate to the window 21 and reflective surface 23. It should be appreciated that as wiper blade 17 passes between window 21 and reflective surface 23, the optical signal may be substantially blocked; indicating that paddle 10*b* has made a full revolution.

The present invention may utilize the rise and fall of the optical signal to detect the positioning of the paddle 10*b* along the path α. The optical signal may then be output as a voltage, wherein the voltage varies with the degree of light received by the sensor receiver 35. The signal may be sensed at a given time increment, which may be any time increment, such as a predetermined time increment or defined by pulses of the microprocessor 16 (illustrated in FIG. 1). The determined time increment may be any time between, e.g., 10-20 ms, including all increments therebetween such as 11 ms, 16 ms, etc. For simplicity, 16 ms will be used herein as a representative example. It should be appreciated however, that all increments and interval calculations may be adjusted according to the desired time increment.

Figure 9:
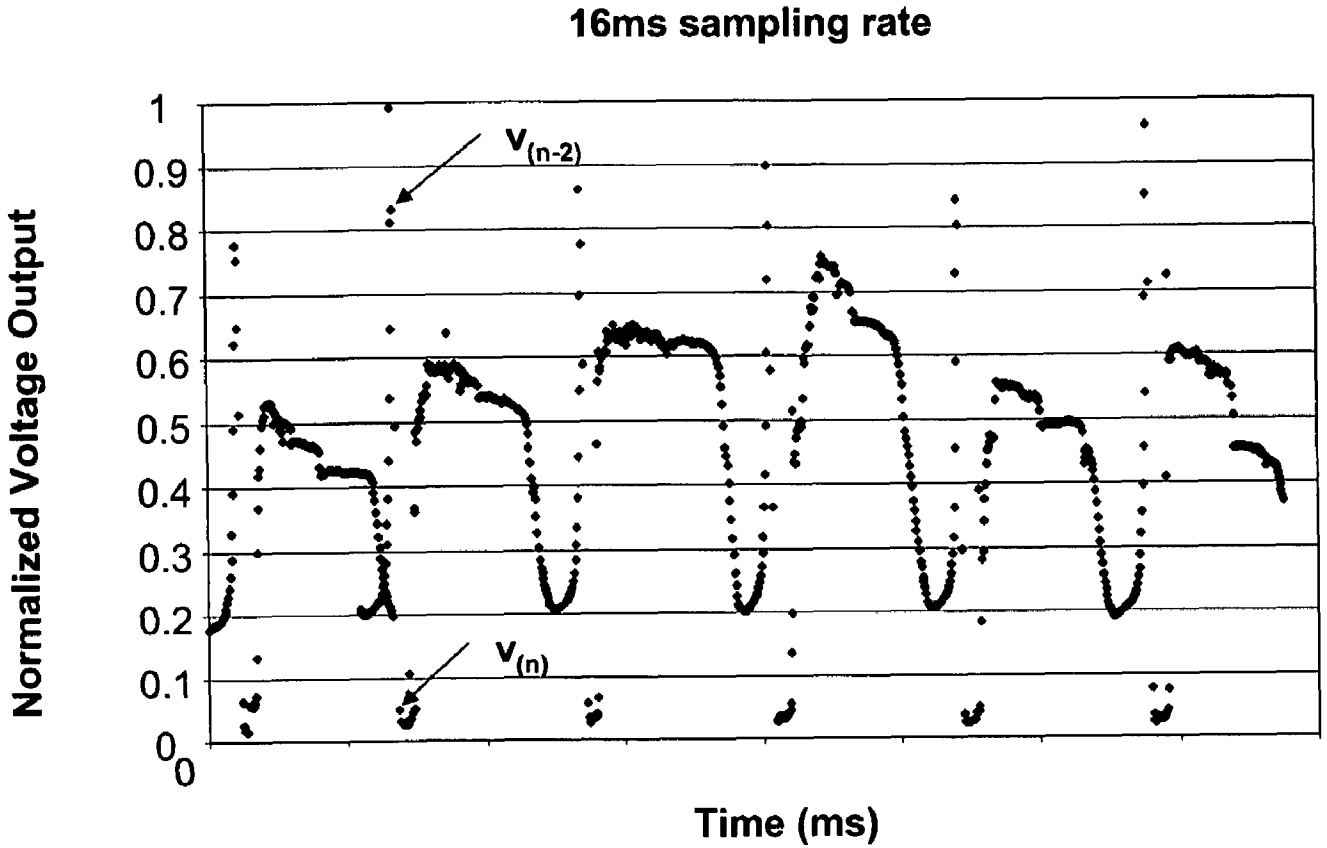
FIG. 9 is a graphical representation of an exemplary output from the sensor at an exemplary sampling rate of 16 ms.

Illustrated in FIG. 9 is an exemplary normalized voltage signal output from the sensor over a period of time at a sampling rate of 16 ms. As can been seen in the figure, the output voltage of the sensor may drop when the wiper goes by the sensor. As the paddle 10*b* rotates around drive shaft 24, an interval, such as $v_{(n-x)}$ and $v_{(n)}$, for example, may be compared and the difference between the signals may be determined. For example, x may be 1, 2, 3, 4, etc., so that one may identify the output voltage change that occurs between any two selected intervals.

It should also be appreciated, however, that the interval may vary depending on the time increment chosen and the sensitivity of the system, such as the sensitivity of the sensor, the amount of interference between the wall interference feature and/or the number of paddles employed. Accordingly, other intervals such as $v_{(n-1)}$ and $v_{(n)}$ or $v_{(n-6)}$ and $v_{(n)}$ and all intervals therebetween may be used. Furthermore, it should be appreciated that at every advancing time increment, the value of n, n−1, etc. may decrease by one in the examples described herein for each of the time increments thereafter. In other words, the value of, e.g., n−2 will become n−3 after an increment of time.

Furthermore, as the toner paddle 10*b* continues to rotate around the drive shaft 24, a minimum ($v_{min}$) and maximum ($v_{max}$) value of the voltage sample signal may be determined. In one embodiment, the minimum value may be the lowest signal value detected and the maximum may be the highest signal value detected while the printer may be on, or during a selected print job. Furthermore, in one embodiment the lowest and highest signal values may be updated as lower and higher signal values, respectively, are sensed.

It may then be possible to compare the difference between the value of the signals at selected intervals, such as ($v_{(n)}-v_{(n-2)}$), or other desired increments and intervals, and the difference between the minimum and the maximum signals, ($v_{min}-v_{max}$). It may also be useful to apply a predetermined factor, f, to assist in comparing the values of ($v_{(n)}-v_{(n-x)}$) and ($v_{min}-v_{max}$). The factor, f, may be, for example, a number between 0.1 and 1 and all values therebetween. One preferred range of values for the factor may be between 0.4-0.7. It can be appreciate that the factor may therefore identify any desired range of signal drop that may be associated with the event of the paddle blocking the sensor. It can also be appreciated that the factor may be selected with consideration of the sensitivity of the sensor or other considerations such as the time increments chosen (e.g., 10, 11, 12 ms) or the time intervals chosen (e.g., $v_{(n)}-v_{(n-2)}$ or $v_{(n)}-v_{(n-3)}$ etc.).

For example, when the value of the difference of every other signal, or other selected time interval, such as ($v_{(n)}-v_{(n-2)}$), becomes less than the value of the minimum signal and the maximum signal, multiplied by the predetermined factor, $(v_{(n)}-v_{(n-2)})<f(v_{min}-v_{max})$, a determination may be made that the paddle has passed the window 21. This calculation may be performed at every time increment. In the case illustrated in FIG. 9, for example, this calculation may be performed every 16 ms. However, it is again emphasized that a number of time increments may be used other than at 16 ms. It can also be appreciated that the above relationship may be rewritten or described in other embodiments, such as wherein $f(v_{max}-v_{min})<(v_{(n-x)}-v_{(n)})$.

Once the toner engaging member has passed by the window, it may then be possible to determine the toner engaging member location when such member is no longer moving. Such location may be determined by a number of alternative methods. For example, the location may be determined by calculating the location of the toner engaging member with respect to the sensor by consideration of the variables of time, toner engaging member velocity or motor speed (i.e., the motor driving the toner engaging member) and any changes in such member velocity or motor speed due to paddle deceleration.

In addition, another sensor may be provided that is in communication with the motor 18 or drive shaft 24. For example, inductive sensors, capacitive sensors, and/or optical sensors may be used to identify the position of toner engaging member 10*b* connected to the drive shaft 24. These sensors may include but are not limited to hall-effect sensors or similar devices, rotary capacitor sensors, or light sensors. These sensors may therefore be used in combination with the optical sensor 21 described above to determine the location of the toner engaging member when the member is no longer moving.

Once the location of the paddle 10*b* has been determined it may be possible to determine how long or how far the paddle must travel to clear the wall feature 14 or other feature within, e.g. a toner cartridge. The drive shaft 24 may then be halted by motor 18 (see FIG. 1) in communication with drive shaft 24. It may be necessary to decelerate motor 18 when halting the motor 18.

Figure 10:
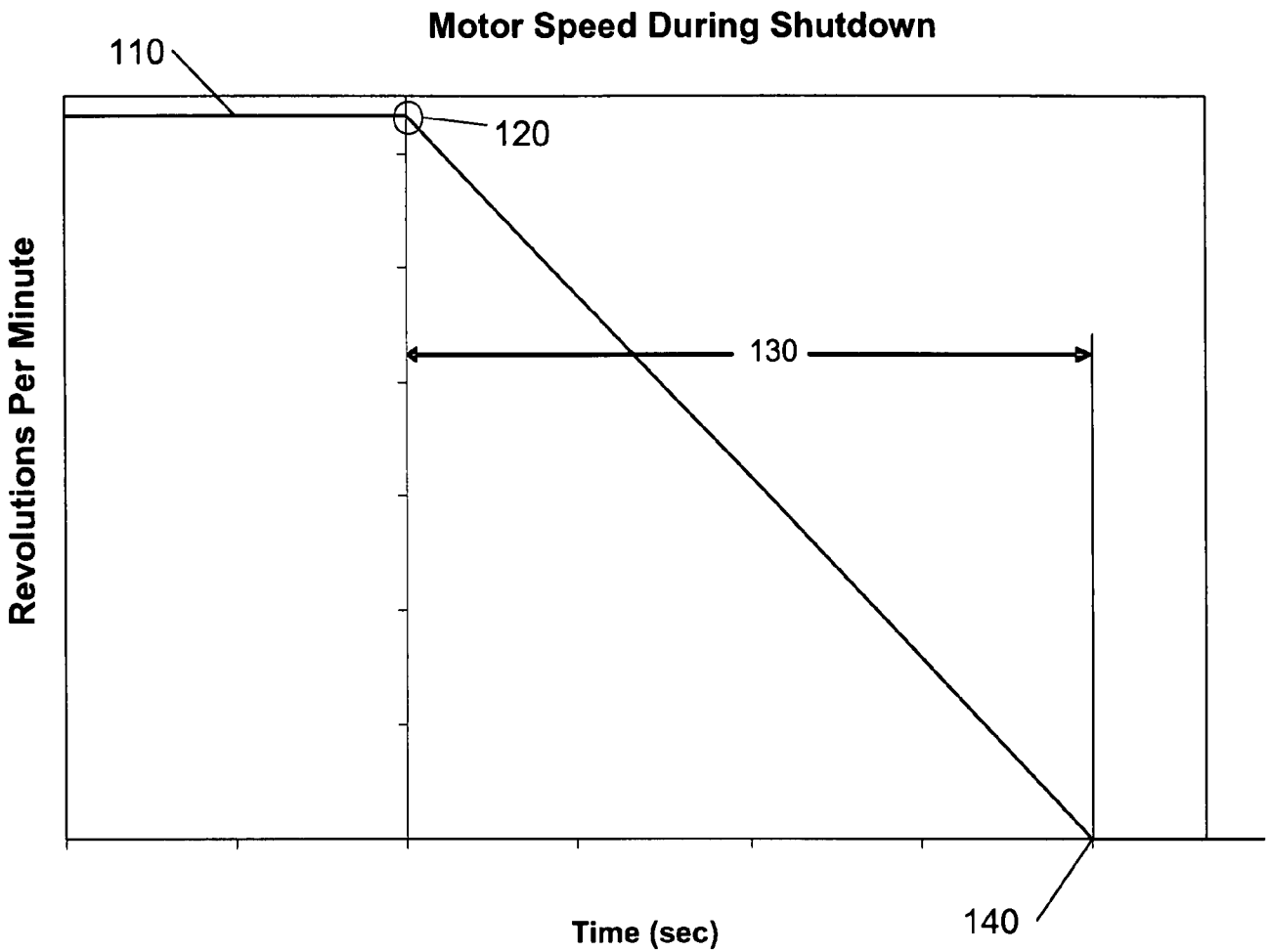
FIG. 10 is a graphical representation of an exemplary embodiment of motor deceleration.

Illustrated in FIG. 10 is an exemplary graphical representation of motor deceleration. At time period 110, the motor 18 may be running at steady state. The motor 18 may rotate at a steady state speed such as between 0 and 5,000 rpm and any value or range of values therebetween, including 2,500 rpm, 400 rpm, or 10 rpm, etc. At point 120, a decision has been made to decelerate the motor. Motor deceleration may occur over a period of time 130 until the motor has either halted or reached a desired rotational speed 140. For example, deceleration may occur between 0.01 seconds to 5 seconds and any value therebetween, including 0.1 seconds, 3 seconds, etc. It should be understood that the amount of time to decelerate may depend upon the degree the motor must be decelerated, the rate at which deceleration occurs, as well other factors. Therefore the time to decelerate the motor may be considered to locate the paddle in a desired position when the motor is stopped.

Additionally, an increment or an adjustment of a few degrees may be included in these calculations to further ensure that the paddle has cleared the interference wall feature 14 or other desired wall feature. Alternatively, or in combination with incorporating an increment or an adjustment of the paddle by a few degrees, the paddle position may be adjusted using the feedback sensors described above, such as the hall-effect, rotary capacitor or light sensors. Accordingly, it may be possible to stop the paddle, determine paddle 10*b* location and move the paddle into a desired location, such as locating the toner agitating device 10*b* in a position that would avoid deflection of the device 10*b*.

There are times, however, when the signals indicate that the sensor used to determine paddle position may be blocked even though the paddle may have not passed in front of the window or the signals indicate that the paddle has not passed in front of the window when it has. This may, for example, be caused by toner movement in the cartridge and may result in extra signals for a single paddle revolution or it may also result in a whole paddle revolution without a signal.

Accordingly, it may be useful to provide a system and method which corrects and compensates for situations where the sensor may be blocked even though the paddle may not be passing in front of the sensor 31. Such system and method may be based on prior revolutions of the paddle 10*b* or wiper 17 passing by the window 21. This then may prevent improper readings, which may cause the paddle 10*b* to be inappropriately placed, such as contacting the wall interference section 14, when the paddle 10*b* may be stopped.

In one embodiment, a revolution of the paddle may be divided into radial segments. The segments may be any desired value and may provide sufficient resolution to approximately locate the paddle as it passes in front of the sensor 31 and then across the inference feature of the wall 14. In one embodiment, the segments may be 3 degrees of paddle rotation along path α, or smaller, and in another embodiment the segments may be 10 degrees in length or larger. It may also be appreciated that the segments correspond to physical locations along path α in the cartridge.

Each time the system observes a voltage drop that may be associated with paddle passing the sensor (e.g., $f(v_{max}-v_{min}) < (v_{(n-2)}-v_{(n)})$) such event may be recorded in memory, such as in memory in the microprocessor, the computer or other memory storage device in communication with the system. In one embodiment, as more revolutions occur, the frequency at which such event occurs may be associated with a given radial segment. From this one may distinguish as between a voltage drop associated with paddle locating and passing the sensor and a voltage drop that may correspond to some other event (e.g., toner accumulating at the sensor).

In another embodiment, each time the system reports that the paddle location occurs in a given segment, the number of occurrences in that segment (e.g. a first segment) may be recorded and increased. The system may then report the occurrence of the paddle in a different segment (e.g. a second segment). The system may then reduce the number of occurrences recorded the first segment in favor of the occurrence in the second segment. In the event that the system reports the occurrence of the paddle location in a third segment, the occurrences in the first and second segments may be reduced by one occurrence respectively. The segment containing the largest number of revolutions may then be associated with the event of the paddle passing the sensor. By way of example, a representative embodiment is illustrated in FIG. 11.

Figure 11:
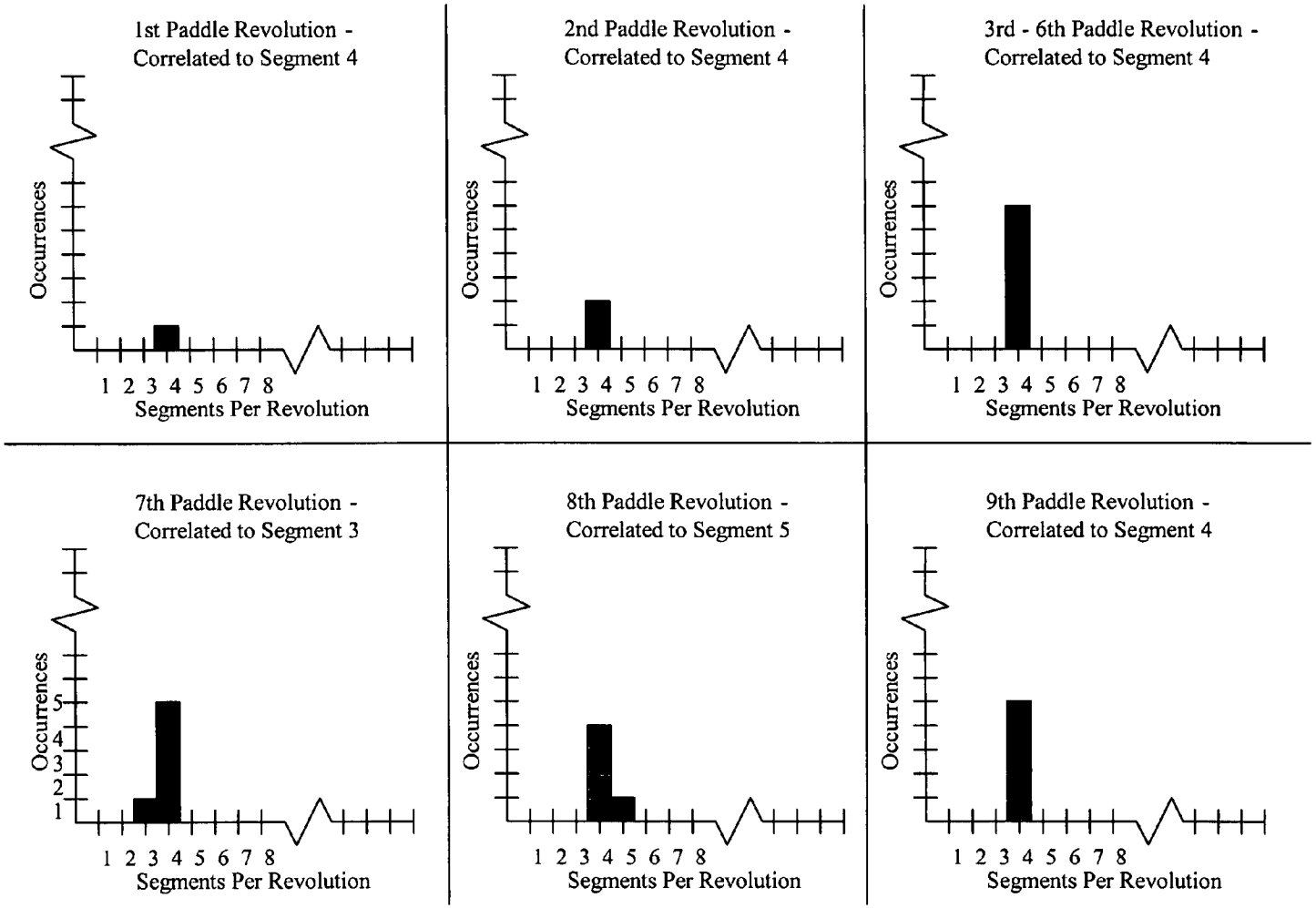
FIG. 11 is a graphical representation of an exemplary embodiment of an averaging calculation for determining predicted paddle location.

As can be seen in FIG. 11, nine revolutions are illustrated in the six charts. In chart 1, at one revolution, an occurrence has been associated with segment 4. In chart 2, a second revolution has occurred and a second occurrence has been associated with the same segment. In chart 3, four more revolutions have occurred and segment 4 has been increased by 4 occurrences. In chart 4, a seventh revolution has occurred but this revolution has been associated with segment 3. In this case, the segment in which the revolution occurs is recorded, thus segment 3 increases by 1 and segment 4 is decreased by one. In chart 5, an eighth revolution has occurred and associated with segment 5. Accordingly, the other segments, 3 and 4, are decreased by one. In chart 6, a ninth revolution has occurred in segment 4 and segment 5 has been decreased by one.

There may be two exceptions to this embodiment. If a segment is at zero, it is not decreased to a negative number. In addition the system may be set so that once a segment has a selected number of reported occurrences; additional occurrences may not be reported for the related segment.

It should be appreciated however, that assigning more segments to the path α may provide increased sensitivity with respect to the objective of determining paddle location. For example, if the segments are too long, it may not be possible to "sense" the paddle at the interference feature with the highest reliability. It should also be appreciated that alternatively to recording the occurrence of paddle location relative to a segment, one may also monitor paddle location in terms of time. In other words, in FIG. 11 the number of segments in the x-axis may therefore be replaced by a time value.

It should also be appreciated that these systems and methods may be employed and/or manipulated when the paddle location is changed. Change of paddle location may occur when the cartridge is removed and/or replaced and may be triggered by the opening of the printer door proximate to the toner cartridge. Thus, when the printer door is opened, the average calculations described above may be modified to adjust for situations where the last location of the paddle, as understood/calculated by the system, may be altered (e.g., replacement of the toner cartridge).

The adjustment may apply via the use of a specified factor, for example, the number of revolutions recorded in a given segment may be decreased by 50-90% to facilitate the system adjustment and therefore allow the system to more quickly identify paddle location if it has been changed. Alternatively, the system may decrease the historical number of recorded occurrences of the paddle location in the given sectors to a selected number (e.g. 3-10) so that the system may record the future occurrences of the paddle location in the sectors. It should therefore be understood that these factors and numbers may be any factor or number that would result in a decrease in the number of recorded occurrences employed in determining the predicted location of the paddle and it also may change the weighting or bias of the average towards a new paddle location. It should also be appreciated that the factors employed may also be predetermined and supplied to the microprocessor.

Figure 12:
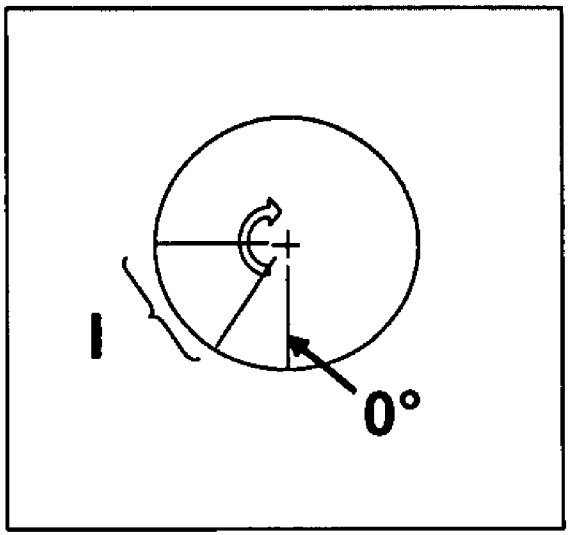
FIG. 12 is a graphical representation of an exemplary embodiment of the amount of interference I between the paddle and interference feature during a revolution of the paddle.

Once the paddle positions have been determined a determination may be made to stop the motor as discussed above, such as when the print job is complete, a standby setting stops the motor, or when a paper jam had occurred. However, if more than one toner cartridge is used in the printer it may be necessary to stop multiple paddles. Accordingly, a microprocessor may be supplied so that it may take into account paddle locations where more than one cartridge in the printing device may be present.

Where it is necessary to take into account multiple paddles in multiple cartridges, the paddle locations for each cartridge may be taken into account and monitored by the microprocessor. The number of cartridges that may be stopped at the same time may therefore depend on a number of factors, including the distance of interference I between the paddle 10*b* and the interference feature of the wall 14, illustrated in FIG. 12. As an illustration, if the distance of interference is less than 90 degrees in each cartridge, it may be possible to stop up to four paddles. Alternatively, if the distance of interference is less than 60 degrees in a plurality of cartridges, it may be possible to stop up to six paddles. Accordingly, any number of cartridges may be employed and a plurality of paddles may be stopped to avoid interference with the wall feature 14. Once again it may be particularly useful to adjust for a few degrees of rotation so that the paddles may have cleared the interference sections of the wall. It should also be appreciated that this same principal may be applied to a single paddle if the paddle contains more than one paddle segment, located about the axis of shaft 24.

Figure 13:
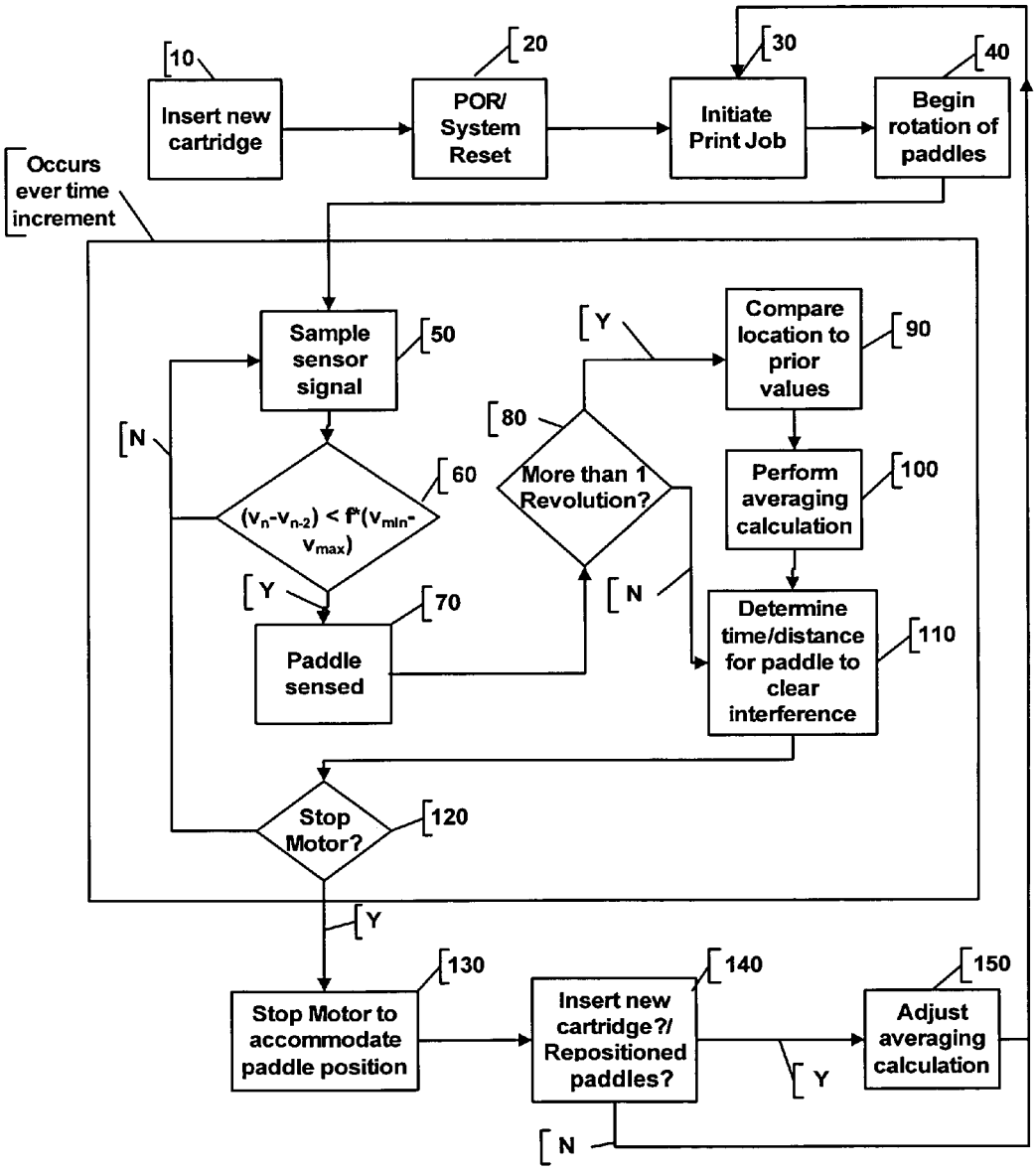
FIG. 13 is a flow chart illustrating an exemplary embodiment relating to a method of the present invention.

The above system and method is illustrated in the flow chart in FIG. 13. A new toner cartridge may be inserted into the printer, 10. The printer may then be turned on, or reset at 20. Then a print job may be initiated at 30. Once the print job is initiated, the paddles 10*b* inside of the toner reservoir 10*a* may be set in motion and begin to rotate about drive shaft 24 at 40. Then at every time increment, the toner low sensor may sample an optical signal 50.

The difference between the signals at every other time interval, such as $(v_{(n)}-(v_{(n-x)})$, may be compared to the difference between the minimum and the maximum $(v_{min}-v_{max})$ values of the signals, at 60. If the difference of the short range signals $(v_{(n)}-(v_{(n-x)})$ is less than or equal to the difference of the long range signals $(v_{min}-v_{max})$, taking into account a factor f, then the system may wait for the next sampling to occur at 50.

If the difference of $(v_n-(v_{(n-x)})$ is less than the difference of $(v_{min}-v_{max})$, taking into account a factor f, then the paddle may be considered as having been sensed as passing between the window and the reflective element and blocking the optical signal, at 70. Once again, it should be appreciated that the expression of this relationship may be altered to accomplish the same result. For example, the system may utilize the relationship $f(v_{max}-v_{min})<(v_{(n-x)}-v_{(n)})$ to identify that the paddle has passed between the window and reflective element.

A determination may then be made as to whether more than one revolution has occurred 80. If more than one revolution has occurred, the system next will compare the location to prior values and perform averaging calculations (see e.g. FIG. 11) at 90 and 100.

Once an averaging calculation has been performed at 100, or if only one revolution has occurred at 80, a time/distance calculation may be performed to determine the time and distance that is necessary for the paddle to clear the interference feature of the wall, at 110. If a signal has not been sent to stop the motor at 120, then the optical signal may be sampled again at 50.

If a signal has been sent to stop the motor at 120, then a motor shut down routine may be initiated at 130. During the shut down procedure, in one exemplary embodiment, the motor ramp down time or rate of deceleration may be determined and coordinated with the amount of time necessary for the paddle to clear the interference feature. In addition and/or alternatively, a sensor may be employed to check the location of the paddle once it has stopped and adjust the paddle position. In another embodiment, the motor may be allowed to coast to a stop, regardless of the paddle location.

Once the motor is shut down, it may be determined whether there has been a new cartridge placed into the printer or if for some other reason, the printer paddles have been otherwise rotated at 140. If the paddles have been displaced, then the averaging values in the averaging calculations are adjusted for the next printing cycle at 150 and the system may wait for the print job to be either initiated or re-initiated at 30. If it is determined that the paddle location has not changed at 140, then the printer may wait for the next print job to be initiated at 30.

Figure 14:
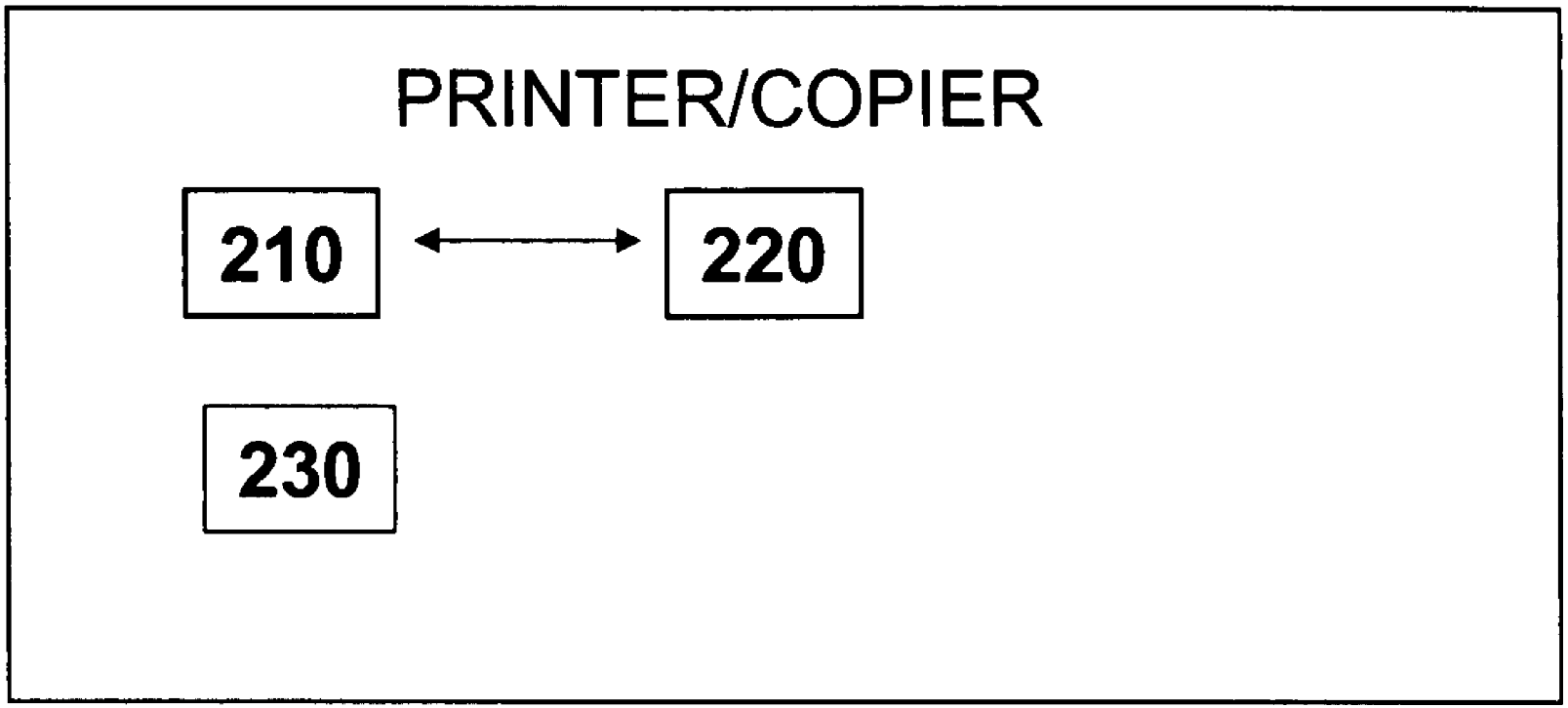
FIG. 14 is an illustration of an embodiment of the present invention relating to an article of machine readable media in relation to a processor and a user interface.

It should also be appreciated that the functionality described herein for the embodiments of the present invention may be implemented by using hardware, software, or a combination of hardware and software, either within the printer or copier or outside the printer copier, as desired. If implemented by software, a processor and a machine readable medium are required. The processor may be of any type of processor capable of providing the speed and functionality required by the embodiments of the invention. Machine-readable memory includes any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format. Accordingly, in the broad context of the present invention, and with attention to FIG. 14, the printer or copier may contain a processor 210 and machine readable media 220 and user interface 230.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practices in the art in which this invention pertains and which fall within the limits of the appended claims.

What is claimed is:

1. A method comprising:

providing a developing agent device including a toner reservoir, capable of containing toner, including a toner engaging member capable of contacting toner;

providing a sensor within said developing agent device wherein said sensor is capable of providing signals;

sampling signals from said sensor;

determining when said toner engaging member engages said sensor, wherein said signals are indicative of a location of said toner engaging member along a path within said toner reservoir; and positioning said toner engaging member at a selected location along the path within said toner reservoir in response to said signals.

2. The method of claim 1 wherein determining when said toner engaging member engages said sensor comprises:

monitoring an output voltage v of said sensor at a time n and a previous time n-x to provide an output voltage difference $(v_{(n)}-v_{(n-x)})$;

measuring a maximum voltage output $v_{max}$ and a minimum voltage output $V_{min}$ and calculating $(v_{min}-v_{max})$;

wherein said toner engaging member is determined to engage said sensor when $$(v_{(n)}-v_{(n-x)})>f(v_{min}-v_{max})$$

wherein f is a constant.

3. The method of claim 1 wherein said developing agent device further includes an interference feature, wherein said toner engaging member deforms when contacting said interference feature.

4. The method of claim 3, including the step of moving said toner engaging member and positioning said toner engaging member at a location other than in contact with said interference feature.

5. The method of claim 1, wherein said toner engaging member includes a wiper blade to engage said sensor.

6. The method of claim 1 wherein said sampling occurs at a time increment and wherein said time increment is between about 10-20 milliseconds.

7. The method of claim 1 further comprising determining when toner engages said sensor.

8. A method comprising:

providing a developing agent device, capable of containing toner, including a toner engaging member capable of contacting toner;

providing a sensor wherein said sensor is capable of providing signals;

sampling signals from said sensor; and determining an event occurrence by monitoring an output voltage v of said sensor at a time n and a previous time n-x to provide an output voltage difference $(v_{(n)}-v_{(n-x)})$;

measuring a maximum voltage output $v_{max}$ and a minimum voltage output $v_{min}$ and calculating $(v_{min}-v_{max})$;

wherein said event is determined to occur when $$(v_{(n)}-v_{(n-x)})<f(v_{min}-v_{max})$$

wherein f is a constant and said event may be associated with said toner engaging member engaging said sensor and/or said toner engaging said sensor.

9. The method of claim 8 including the step of distinguishing between said toner engaging member engaging said sensor and toner engaging said sensor.

10. A printer comprising:

a toner containing device including a toner reservoir, capable of containing toner, including a toner engaging member capable of contacting toner;

a sensor wherein said toner engaging member is capable of engaging said sensor; and a processor in communication with said sensor capable of sampling signals from said sensor and determining when said toner engaging member engages said sensor, wherein said signals are indicative of a location of said toner engaging member along a path within a toner reservoir, and wherein said processor, during operation, positions said toner engaging member at a selected location along the path within said toner reservoir in response to said signals.

11. The printer of claim 10, wherein said step of determining when said toner engaging member engages said sensor includes said processor being further capable of monitoring an output voltage v of said sensor at a time n and a previous time n-x to provide the output voltage difference $(v_{(n)}—v_{(n-x)})$, measuring a maximum voltage output $v_{max}$ and $v_{min}$ and calculating $(v_{min}-v_{max})$; wherein said toner engaging member is determined to engage said sensor when $$(v_{(n)}-v_{(n-x)})<f(v_{min}-v_{max})$$

wherein f is a constant.

12. The printer of claim 10, wherein said toner containing device further comprises an interference feature, wherein said toner engaging member is capable of deforming upon contact with said interference feature.

13. An article comprising:

a storage medium having stored thereon instructions that when executed by a machine result in the following operations:

sampling signals from a sensor;

determining when a toner engaging member engages said sensor, wherein said signals are indicative of a location of said toner engaging member along a path within a toner reservoir in a toner containing device; and positioning said toner engaging member in said toner containing device at a selected location along the path within said toner reservoir in response to said signals.

14. The article of claim 13, wherein said instructions that when executed by said machine in determining when said toner engaging member engages said sensor result in the following additional operations:

monitoring an output voltage v of said sensor at a time n and a previous time n-x to provide the output voltage difference $(v_{(n)}-v_{(n-x)})$;

measuring a maximum voltage output $v_{max}$ and $v_{min}$ and calculating$(v_{min}-v_{max})$;

wherein said toner engaging member is determined to engage said sensor when $$(v_{(n)}-v_{(n-x)})<f(v_{min}-v_{max})$$

wherein f is a constant.

15. A toner cartridge comprising:

a toner containing device including a toner reservoir, capable of containing toner, including a toner engaging member capable of contacting toner;

a sensor wherein said toner engaging member is capable of engaging said sensor and said sensor is capable of communicating with a processor which is capable of sampling signals from said sensor and determining when said toner engaging member engages said sensor, wherein said signals are indicative of a location of said toner engaging member along a path within said toner reservoir, and wherein said toner engaging member is configured to be positioned at a selected location along the path within said toner reservoir in response to said signals.

16. The toner cartridge of claim 15, wherein said step of determining when said toner engaging member engages said sensor includes said processor being further capable of monitoring an output voltage v of said sensor at a time n and a previous time n-x to provide the output voltage difference $(v_{(n)}—v_{(n-x)})$; measuring a maximum voltage output $v_{max}$ and $v_{min}$ and calculating $(v_{min}-v_{max})$; wherein said toner engaging member is determined to engage said sensor when $$(v_{(n)}-v_{(n-x)})<f(v_{min}-v_{max})$$

wherein f is a constant.

17. The toner cartridge of claim 15, wherein said toner containing device further comprises an interference feature, wherein said toner engaging member is capable of deforming upon contact with said interference feature.

* * * * *